United States Patent [19]

Yang

[11] Patent Number: 4,747,590

[45] Date of Patent: May 31, 1988

[54] INTERCONNECTED C-CLAMPS AND TENSIONING MEANS THEREFOR

[76] Inventor: Tai-Her Yang, 5-1 Taipin Street, Si-Hu Town, Dzan-Hwa, Taiwan

[21] Appl. No.: 923,017

[22] Filed: Oct. 27, 1986

[51] Int. Cl.[4] ..... B25B 1/00

[52] U.S. Cl. ..... 269/45; 269/88; 269/249

[58] Field of Search ..... 269/45, 88, 249, 97–100, 269/91, 93, 152–156, 900; 248/231.7, 229; 24/341, 486, 525

[56] References Cited

U.S. PATENT DOCUMENTS

| | | | |
|---|---|---|---|
| 1,126,053 | 1/1915 | McGough | 269/45 |
| 2,466,518 | 4/1949 | Wagner | 269/91 |
| 2,553,802 | 5/1951 | Woods | 269/249 |
| 2,606,583 | 8/1952 | O'Connor | 269/93 |
| 2,636,527 | 4/1953 | Schiemann | 269/97 |
| 2,669,958 | 2/1954 | Sweeney | 269/45 |
| 2,778,393 | 1/1957 | Golasowski | 269/97 |
| 3,883,128 | 5/1975 | Breese | 269/45 |
| 3,934,316 | 1/1976 | Driscoll | 269/249 |
| 4,256,295 | 3/1981 | Egner | 269/45 |
| 4,607,829 | 8/1986 | Suska | 269/249 |

*Primary Examiner*—Robert C. Watson
*Attorney, Agent, or Firm*—Leonard Bloom

[57] ABSTRACT

A C-clamp adapted for interconnection to other like C-clamps and to other tensioning devices by means of at least one threaded adapter. The C-clamp includes a main body portion with five integral leg portions. Threaded apertures are provided through the legs perpendicular to the plane of the main body portion. Blind bores are provided in the legs in a plane parallel to the main body portion. The fourth leg joins the first and second legs and is disposed thereto at an angle of substantially 45 degrees. The fifth leg joins the second and third legs and is disposed thereto at an angle of substantially 45 degrees. Threaded adapters and other tensioning devices are interconnected between individual C-clamps permitting intricate clamping arrays for objects or workpieces having complex shapes.

5 Claims, 21 Drawing Sheets

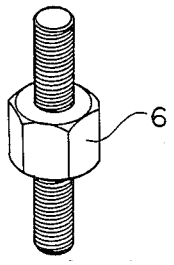
ig. 8
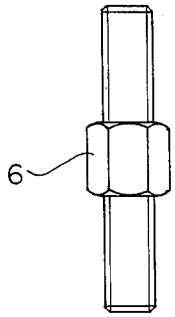
ig. 8-1
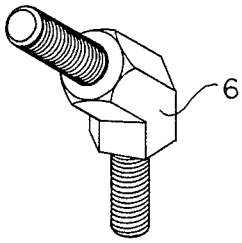
ig. 9
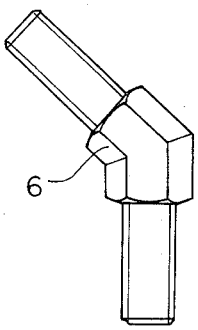
ig. 9-1
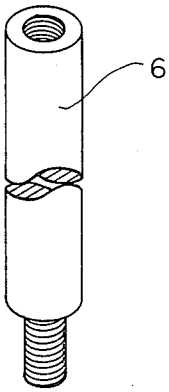
ig. 10
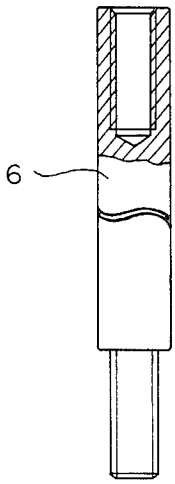
ig. 10-1

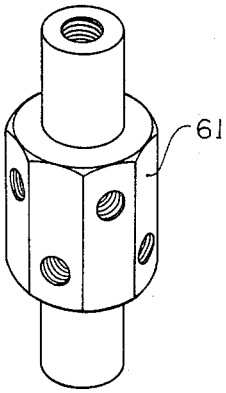
ig. 11
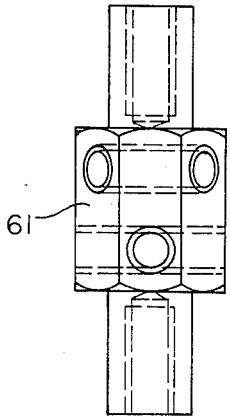
ig. 11-1
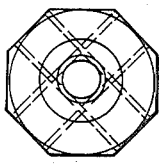
ig. 11-2
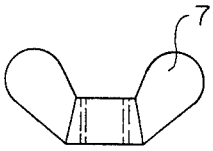
ig. 12-1
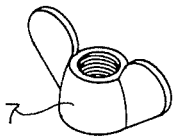
ig. 12

INTERCONNECTED C-CLAMPS AND TENSIONING MEANS THEREFOR

SUMMARY OF THE INVENTION

This is an improved C type clamp. Its features are that a C type shaft body is created as a whole body system or a half-sectioned system, or a multiple-sided connected set system, or an angle adjustable type shaft set that consists of two L-shaped shaft which are connected together by a multiple-sided column.

On four sides or multiple-sides and corner places of a shaft body, there are several threaded holes that are intended to connect other half-sectioned system C type shaft body or to connect a middle connector.

This may be used to clamp an object which has multiple angles, multiple non-paralleled surfaces or paralleled surfaces.

DETAILED DESCRIPTION OF THE INVENTION

A traditional C type clamp consists of a whole C type shaft, its one end is screwed in a threaded piston shaft, posing as a compressive clip structure.

It can be effective when the object to be clamped has two paralleled surfaces. But in other various processing and assembling circumstances if it is needed to clamp several objects at the same time and the objects have non-paralleled surfaces, then it needs several C clamps to fasten the object one by one. As a results, too many clamps are on an object or an equipment. It affects the processing efficiency and is inconvenient for the refinery operation. This invention supplies an independent or an assembled, connected multiple-directioned, multiple-angled, non-paralleled surfaces gripping function. It may be applied to processing or assembling operation, with less clamps and simpler mechanism for fastening simultaneously.

Now, the detailed explanations of the implementation examples of this invention are given as follows in the order of the appendixed Figures.

Figure 1:
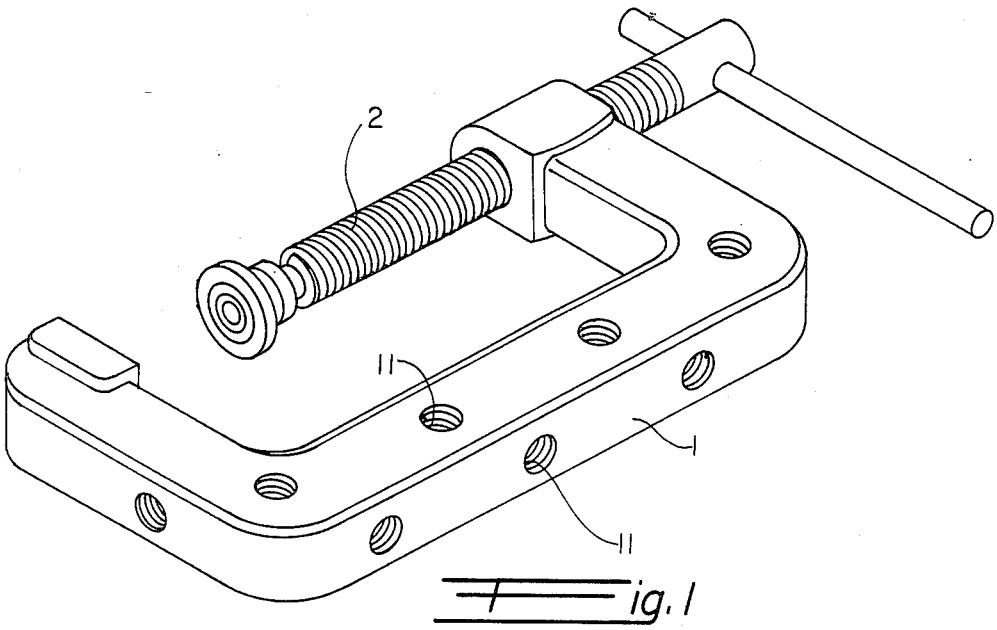
Figure 1:
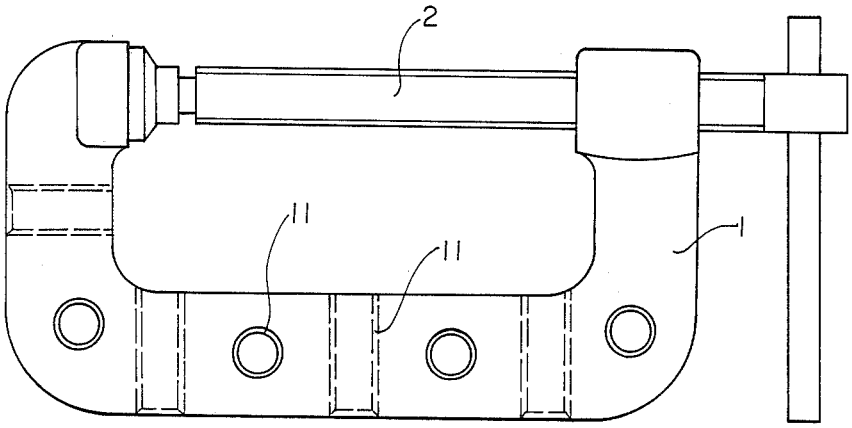

FIG. 1. A solid view of a C type clamp with one bodied C type shaft of this invention.

FIG. 1-1. A a front view of the FIG. 1.

Figure 2:
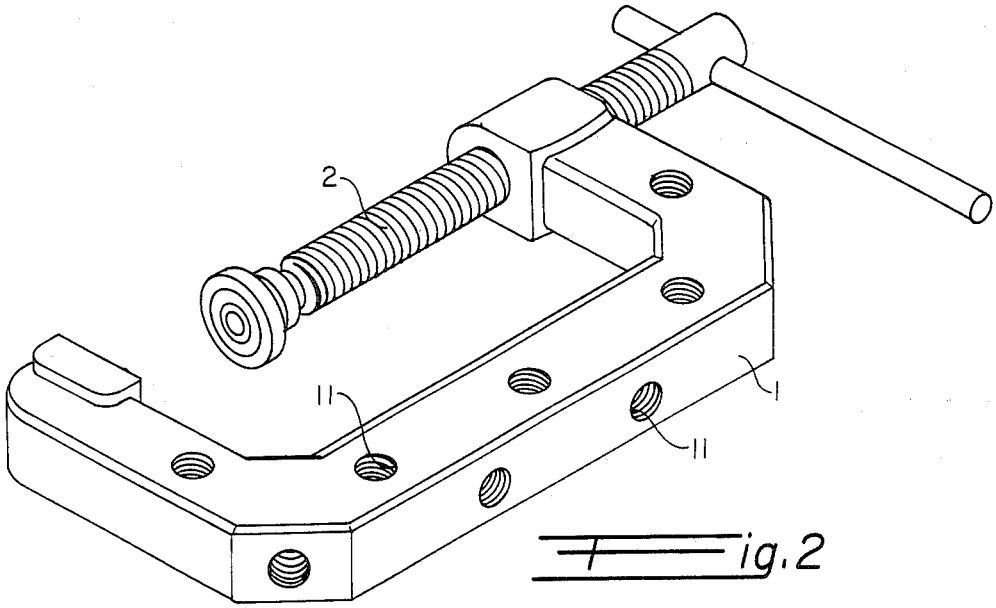
Figures 1, 2:
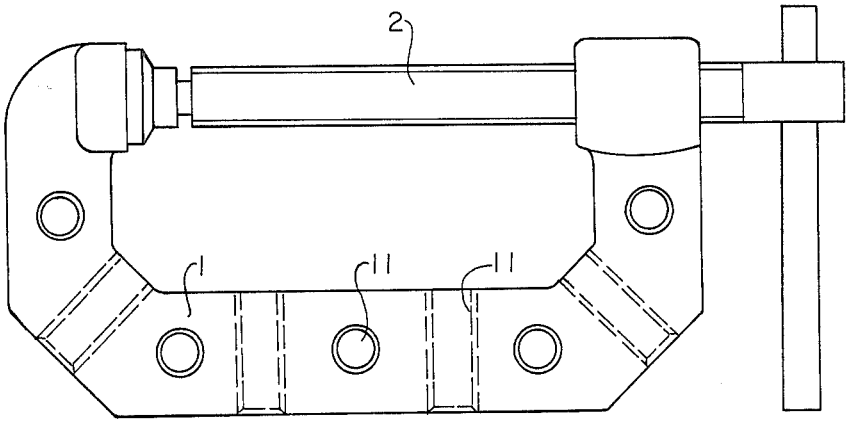

FIG. 2. A solid view of a C type clamp of this invention that has threaded holes at the corner of an one bodied C type shaft.

FIG. 2-1. A front view of the FIG. 2.

Figure 3:
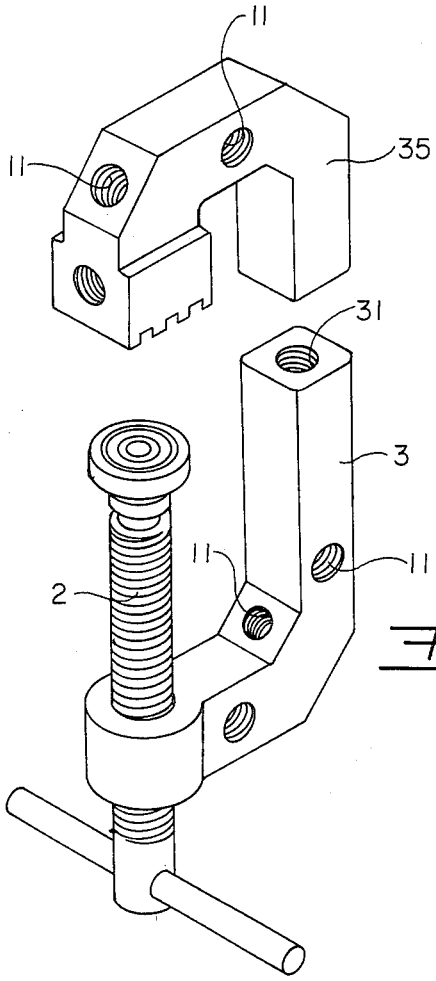
Figures 1, 3:
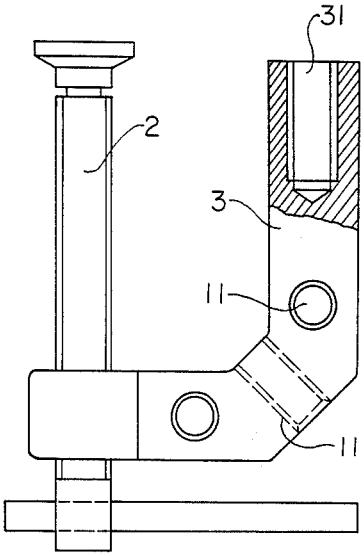
Figures 1, 2, 3:
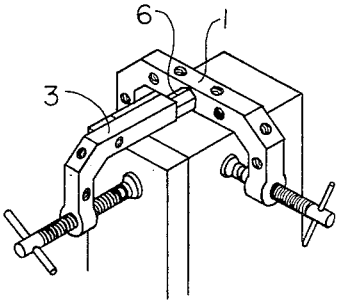
Figures 2, 3:
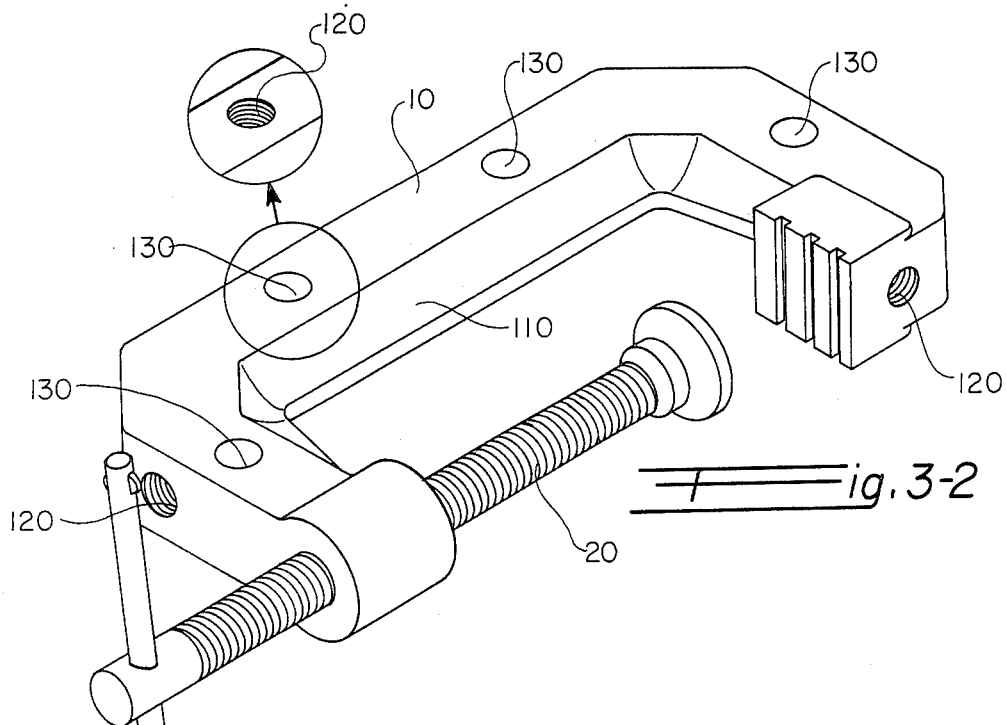
Figure 3:
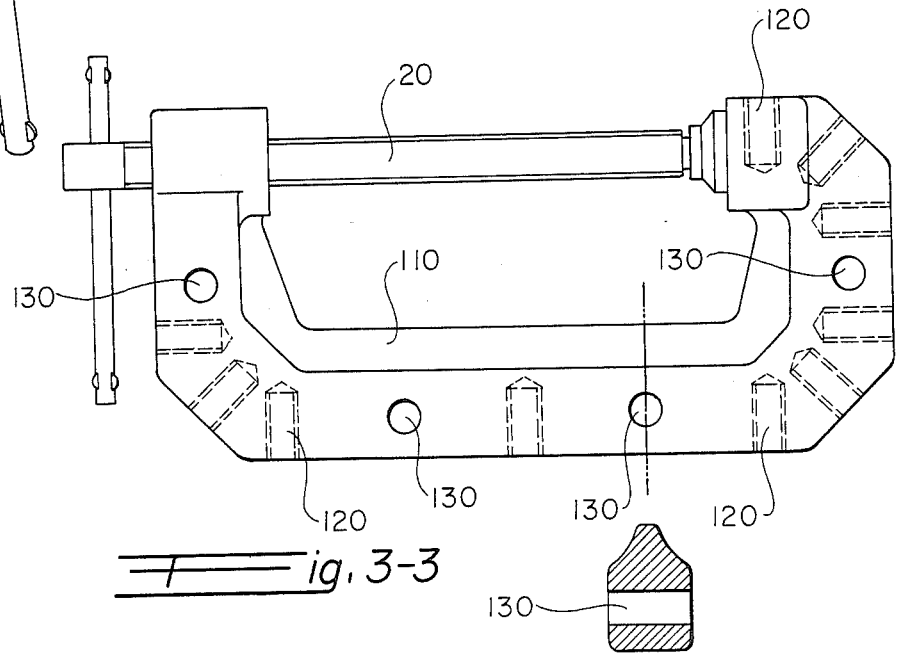

FIG. 3. A solid, disassembled view of an L-type shaft and a half-sectioned type C clamp of this invention.

FIG. 3-1. A front view of the FIG. 3.

FIG. 3-2. A view of the other model of a C type clamp with one bodied C type shaft of this invention.

FIG. 3-3. A front view of a C type clamp with one bodied C type shaft.

Figures 3, 4:
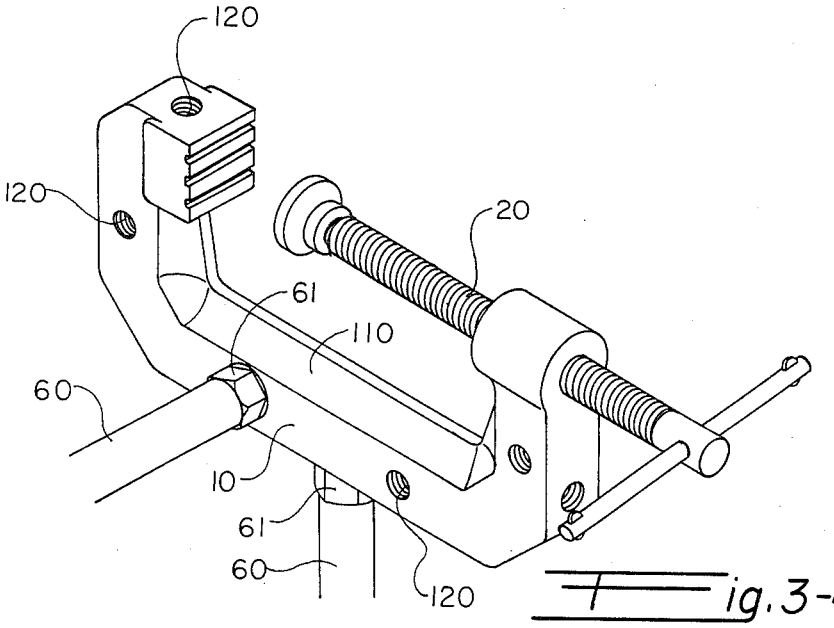

FIG. 3-4. One implementation example that shows this newly invented C type clamp is bolted together with a middle connectors.

Figures 3, 4, 5:
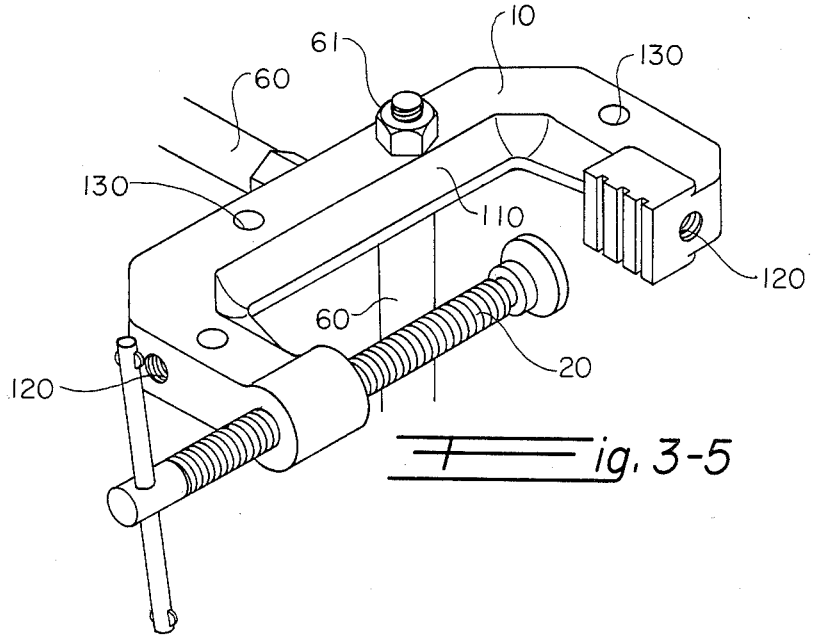

FIG. 3-5. One implementation example that shows this newly invented C type clamp is bolted together with a middle connectors.

FIG. 3-6. A solid view of the other model of a C type clamp that has an L-type shaft of this invention.

FIG. 3-7. A front view of the other model of a C type clamp that has an shaft of this invention.

FIG. 1-2-3. An implementation example of a combination of an one bodied system and a half-sectioned system C type clamps.

FIG. 4. A solid view of a C type clamp of this invention by combining a multiple-sided column to form as a C type shaft.

FIG. 4-1. A front view of the FIG. 4.

FIG. 4-1-1. An implementation example of this invention by combining a C type clamp which is formed by multiple-sided columns and a half-sectioned system C type clamp.

FIG. 5. A solid view of an L-shaped shaft body which is connected with a connecting column by a threaded shaft.

FIG. 5-1. A front view of the FIG. 5.

FIG. 5-2. An implementation example of a C type clamp of this invention by combining an L-type shaft and a connecting column with a threaded shaft.

Figures 3, 4, 5, 6:
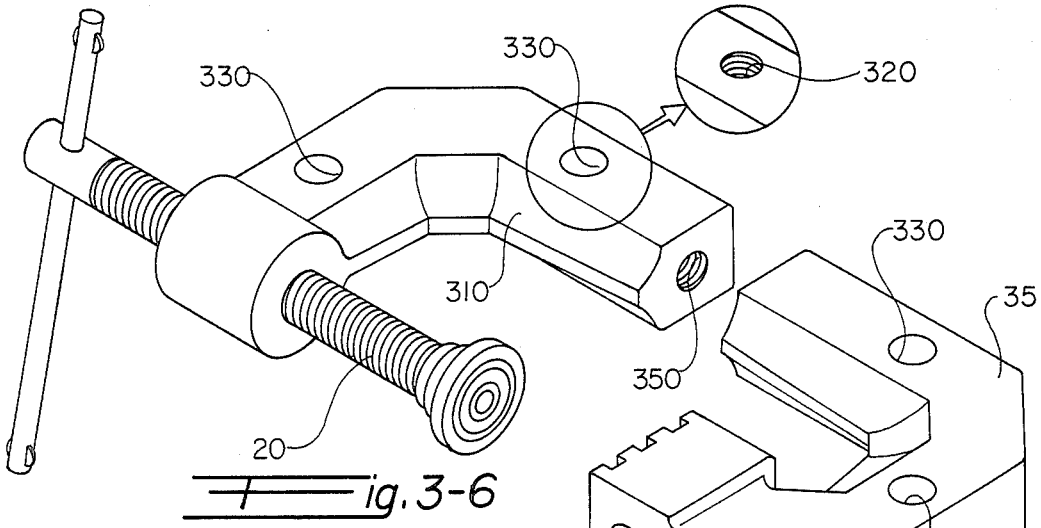

FIG. 6. A solid view of a C type clamp of this invention that is formed by two L-shaped shafts connected with a connecting column.

FIG. 6-1. A top view of the FIG. 6.

FIG. 6-2. A front view of the FIG. 6.

FIG. 6-3. An implementation example of a C type clamp of this invention which has two L-shaped shafts.

Figures 3, 4, 5, 6, 7:
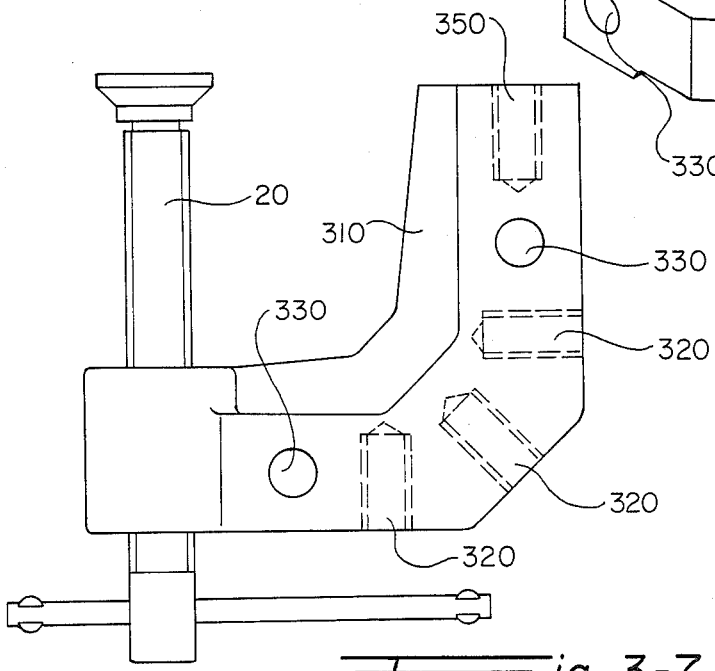
Figure 4:
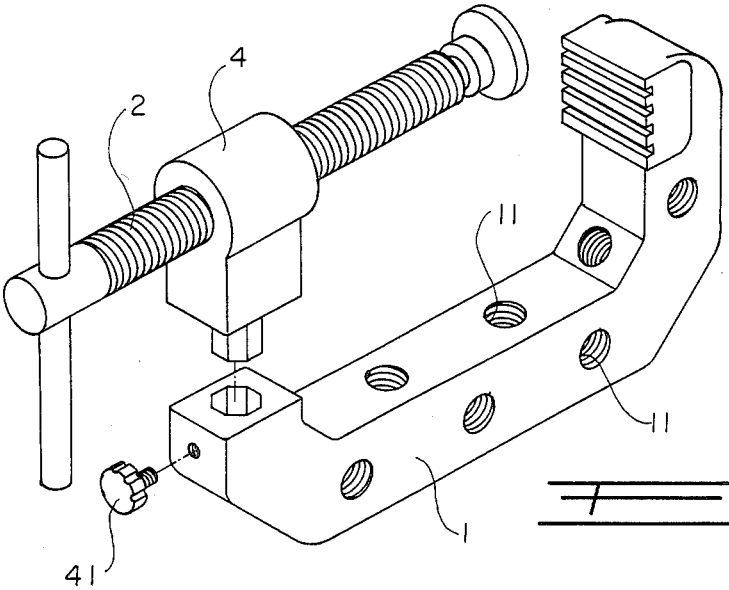
Figures 1, 4:
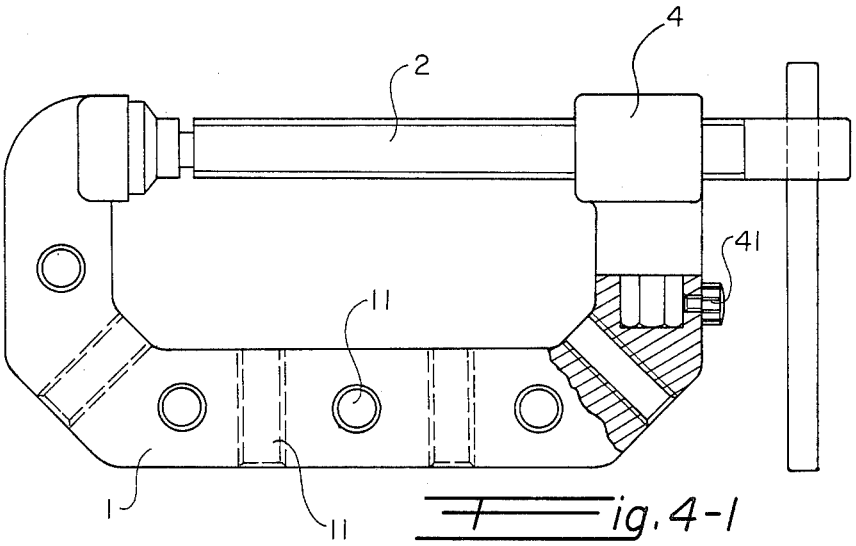
Figures 1, 4:
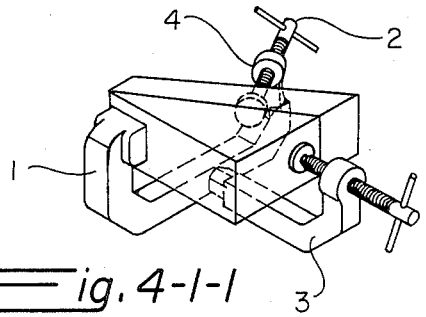
Figure 5:
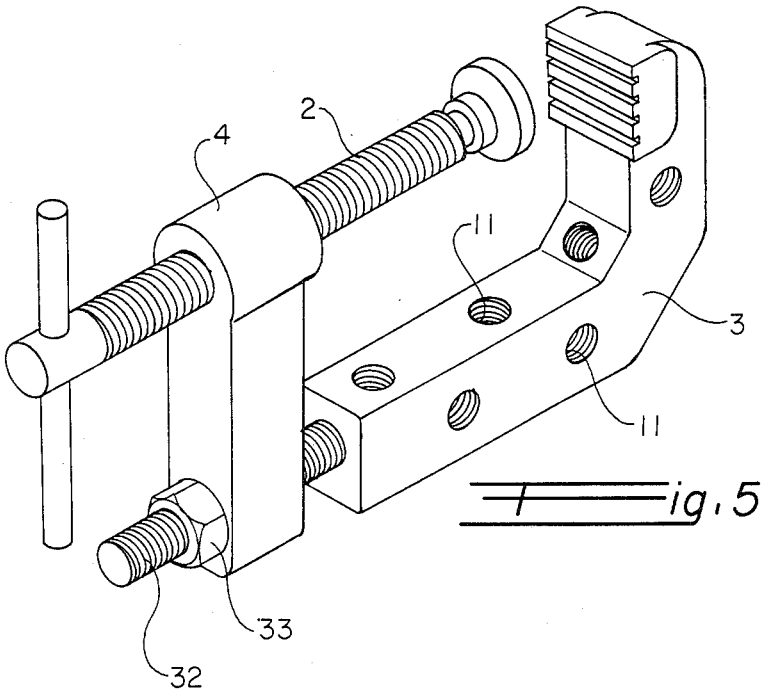
Figures 1, 5:
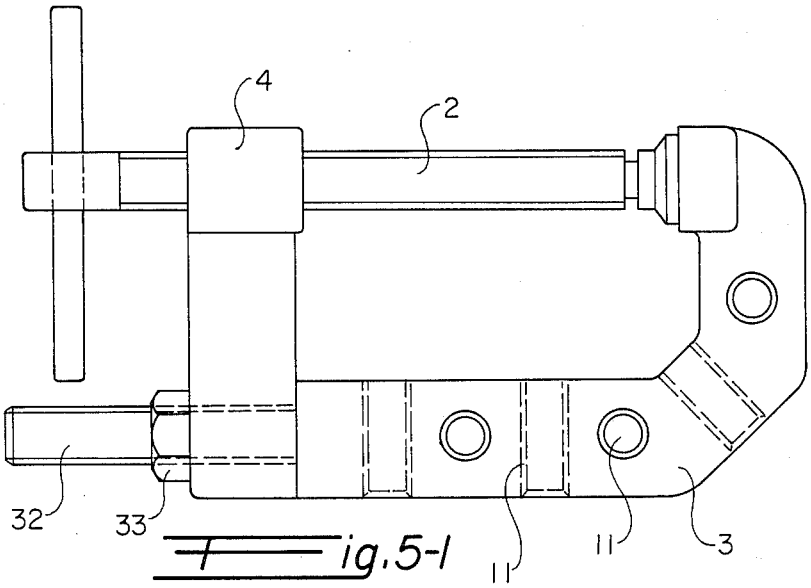
Figures 2, 5:
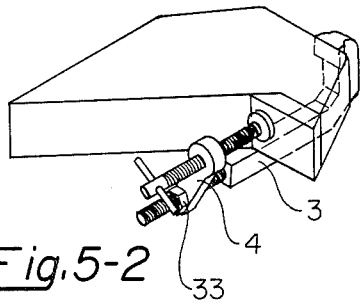
Figure 6:
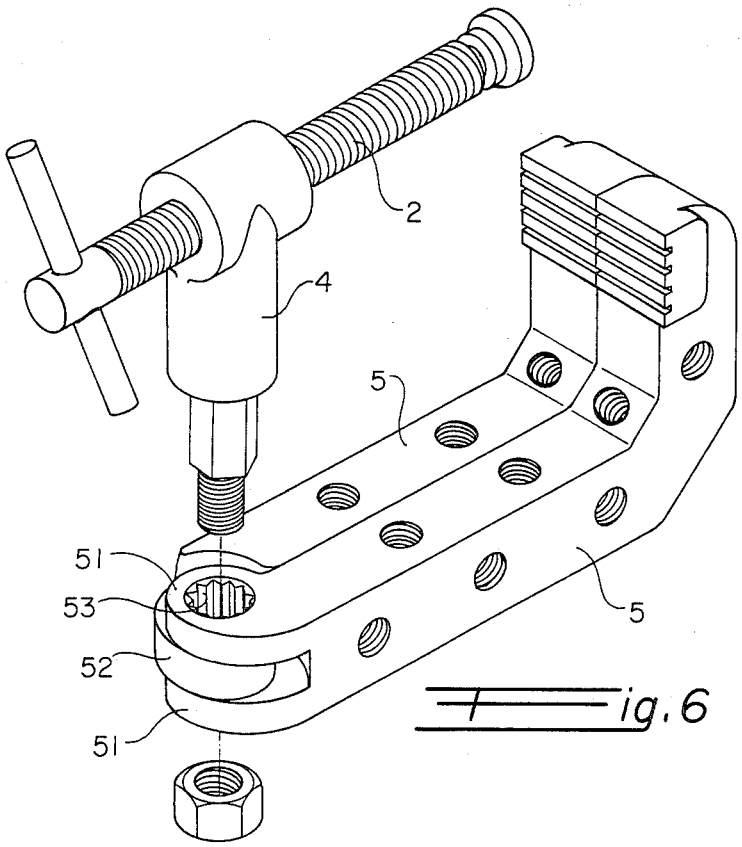
Figures 1, 6:
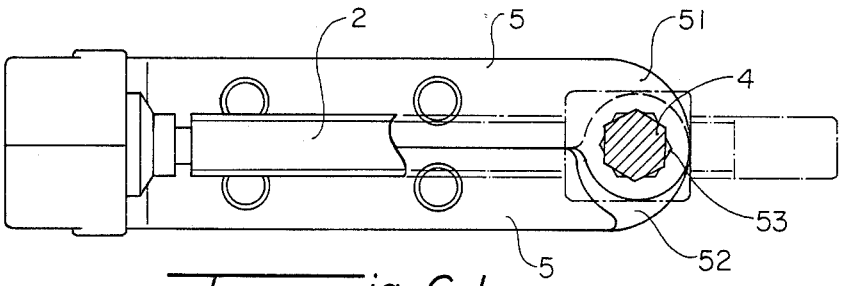
Figures 2, 6:
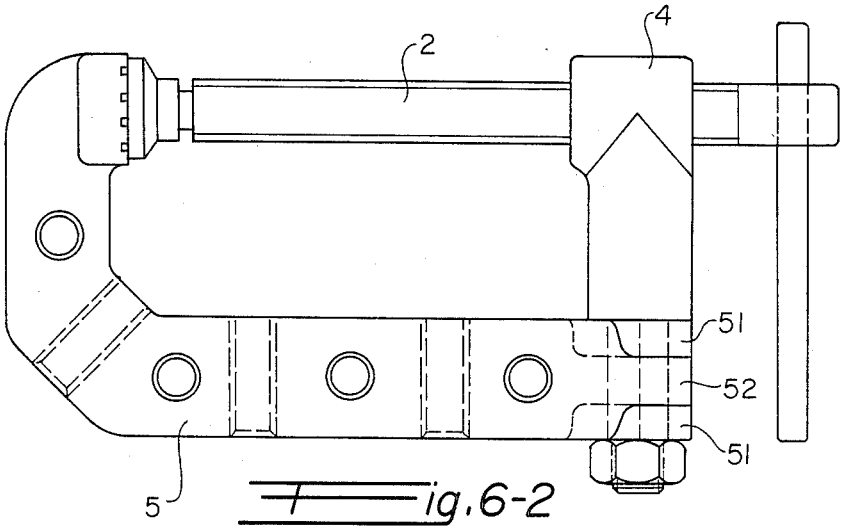
Figures 3, 6:
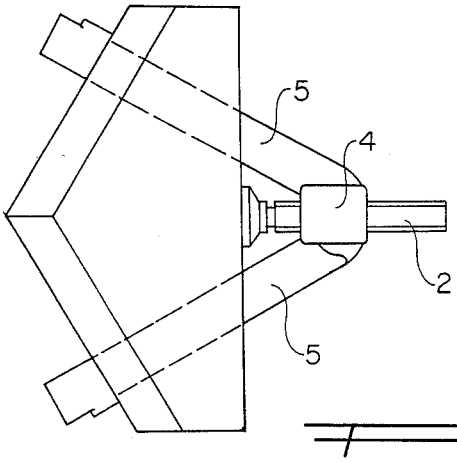
Figure 7:
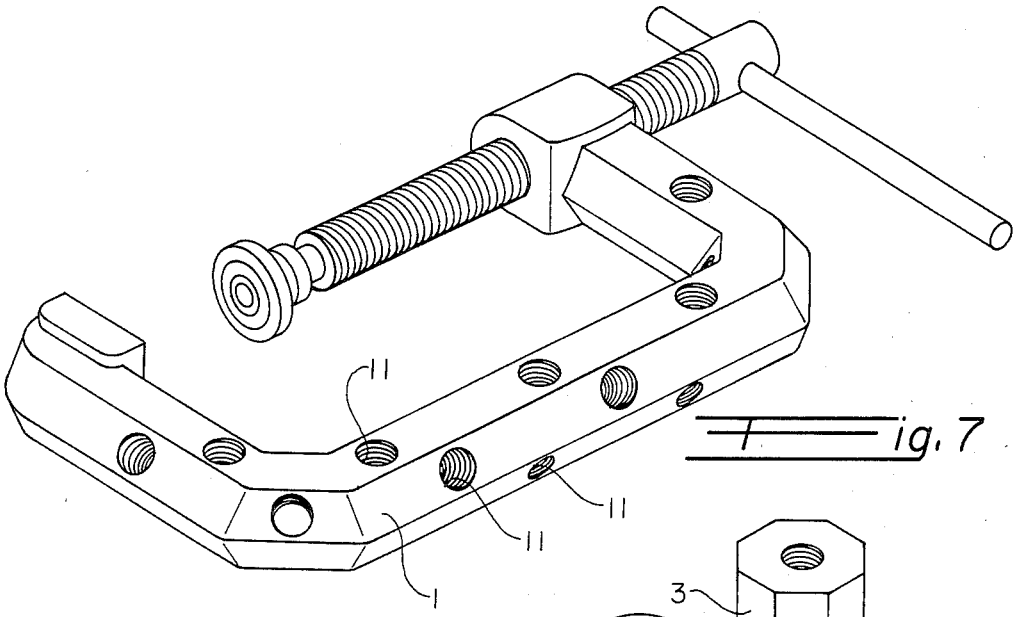
Figures 2, 7:
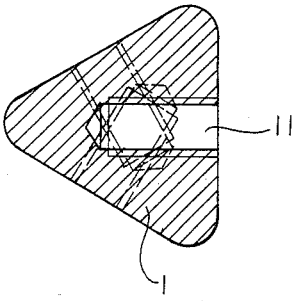
Figures 1, 7:
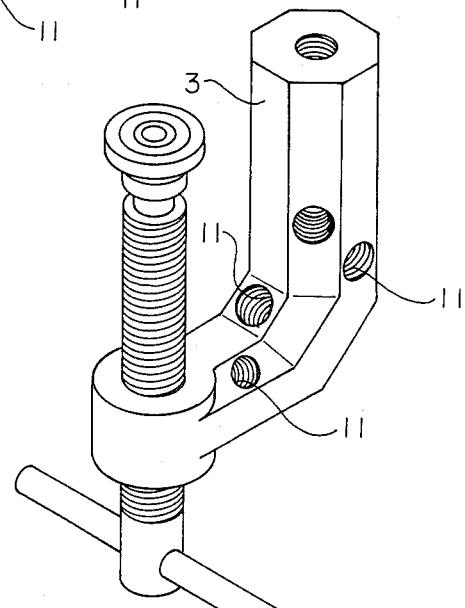

FIG. 7. A solid view of this invention that its C type shaft has a hexagonal sectional view and has threaded holes that are not piercing through.

FIG. 7-1. A solid view of this invention that its L-type shaft has an octagonal sectional view and has threaded holes that are not piercing through.

FIG. 7-2. A triangle sectional view of a C type shaft of this invention.

Figures 3, 8:
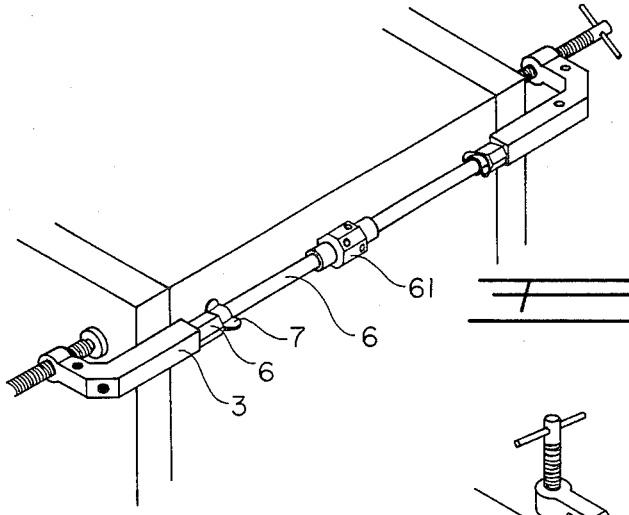
Figures 1, 3, 8:
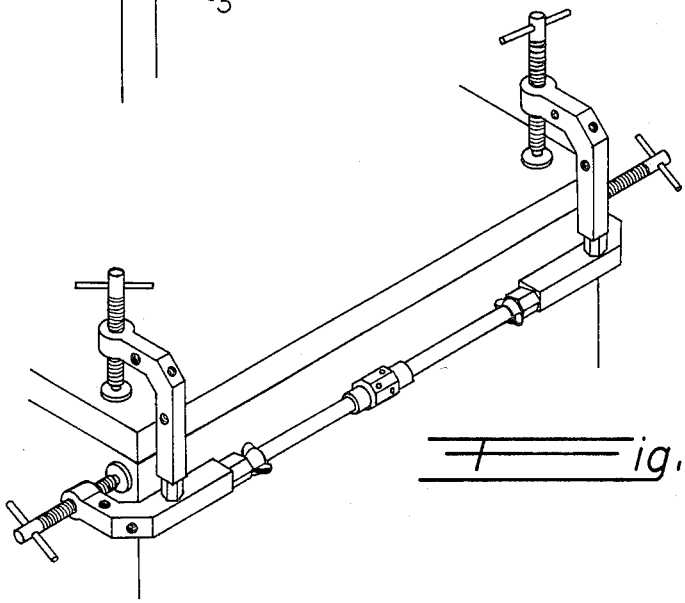
Figures 2, 3, 8:
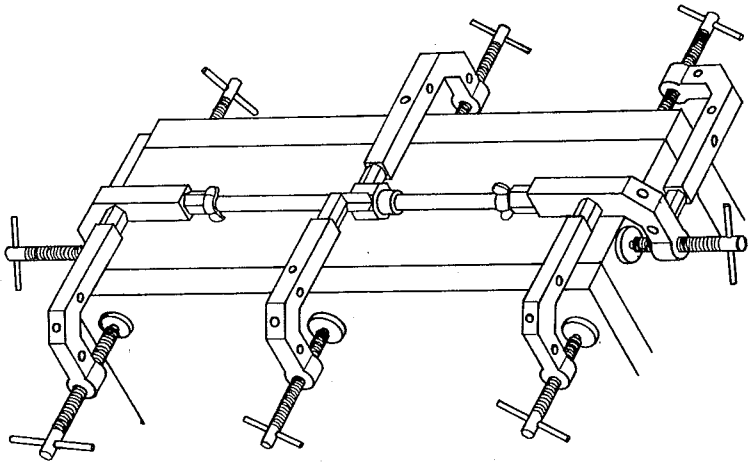

FIG. 8. One of a middle connector of this invention (1).

FIG. 8-1. A front view of the FIG. 8.

FIG. 9. One of a middle connector of this invention (2).

FIG. 9-1. A front view of the FIG. 9.

FIG. 10. A one of a middle connector of this invention (3).

FIG. 10-1. A front view of the FIG. 10.

FIG. 11. One of a middle connector of this invention (4).

FIG. 11-1. A front view of the FIG. 11.

FIG. 11-2. A side view of the FIG. 11.

Figures 2, 12:
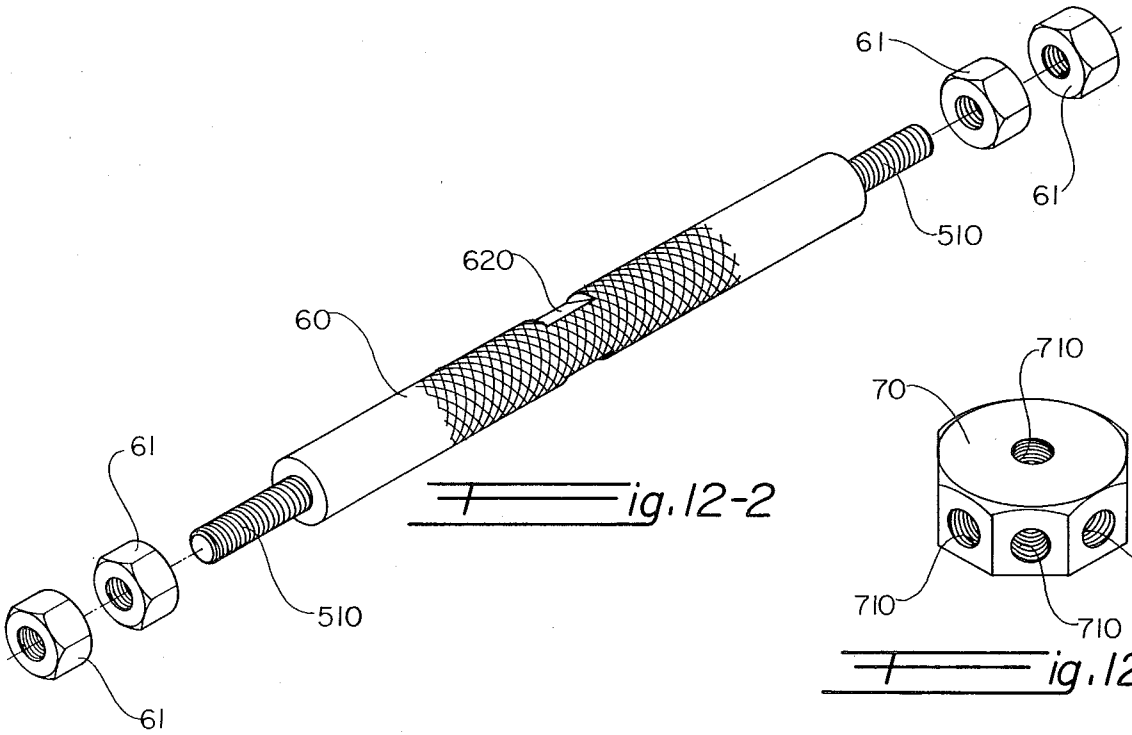
Figures 3, 12:
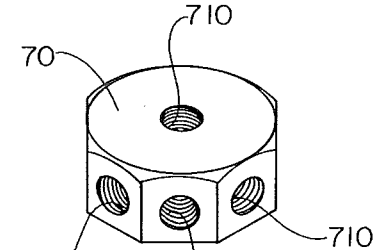

FIG. 12. A solid view of a turning wing nut of this invention.

FIG. 12-1. A front view of the FIG. 12.

FIG. 12-2. A solid, disassembled view of a middle connector and threaded nuts of this invention.

FIG. 12-3. Another solid implementation example view of a central direction diversifying connector of this invention.

FIG. 8-3. The first implementation example of this invention using middle connectors to expand the gripping distance.

FIG. 8-3-1. The second implementation example of this invention using middle connectors to expand the gripping distance.

FIG. 8-3-2. The third implementation example of this invention using middle connectors to expand the gripping distance.

Figure 13:
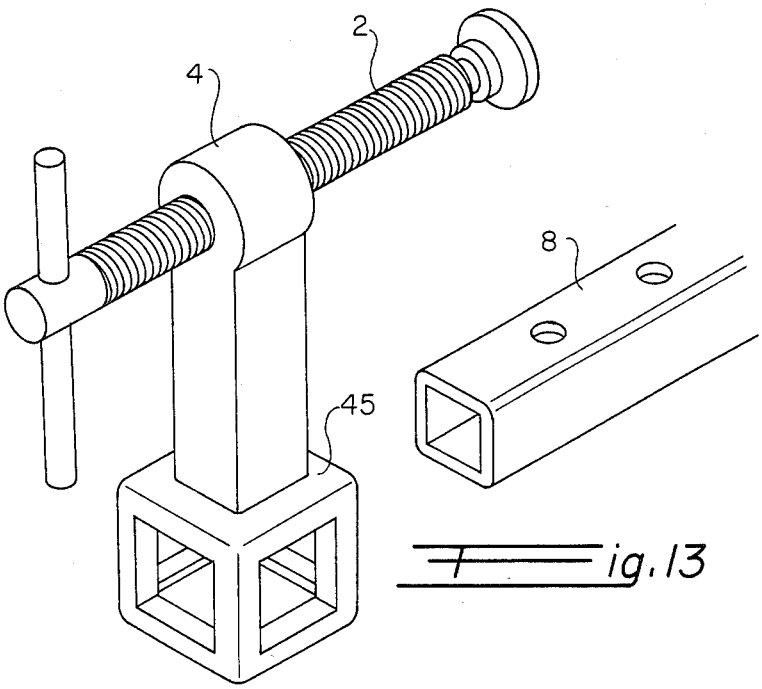
Figures 1, 13:
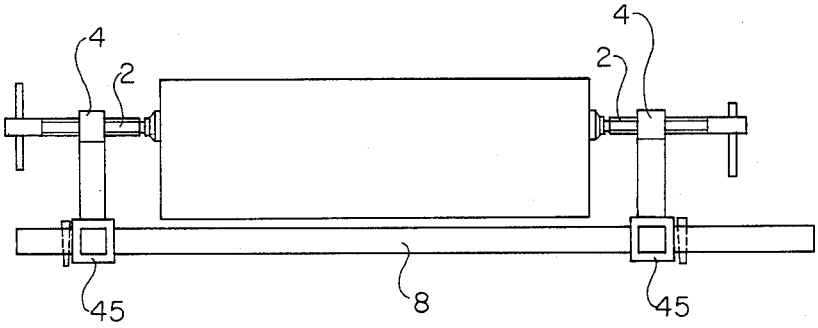
Figures 2, 13:
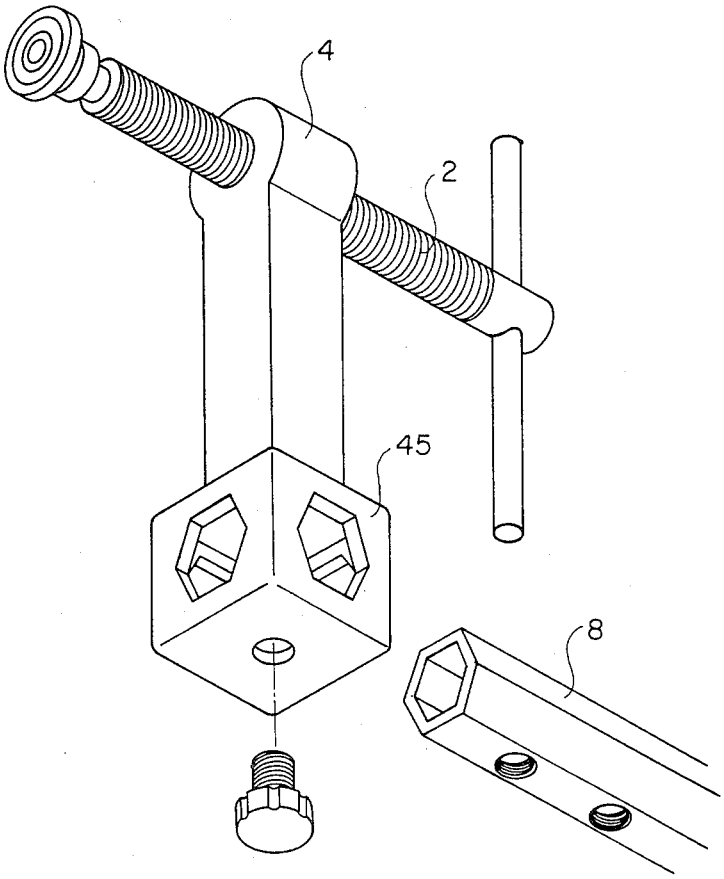

FIG. 13. A solid view of a C type clamp set of this invention that has a square shaped column connector.

FIG. 13-1. An implementation example of a C type clamp of this invention which is formed by two square shape column connectors connected with extension shaft.

FIG. 13-2. A solid disassembled view of this invention that shows an extension shaft and a connecting column are fixed by a bolt.

Figures 1, 14:
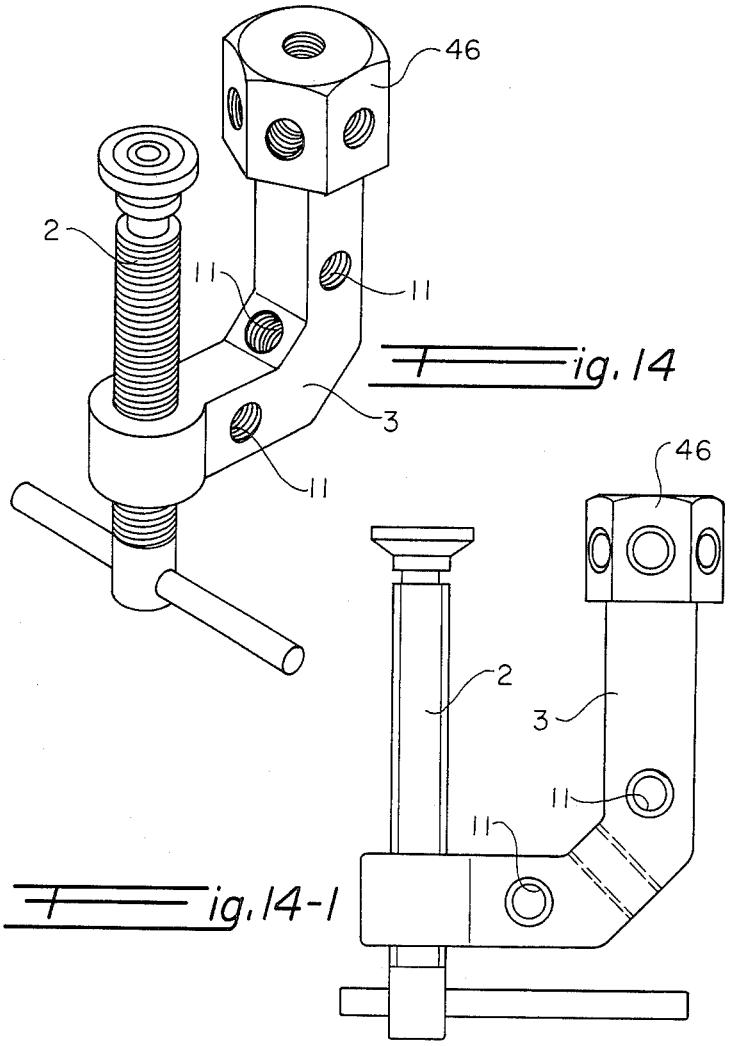

FIG. 14. A solid view of this invention that one end of an L-shaped shaft has multiple-sided body.

FIG. 14-1. A front view of this invention that one end of an L-shaped shaft has multiple-sided body.

Figure 15:
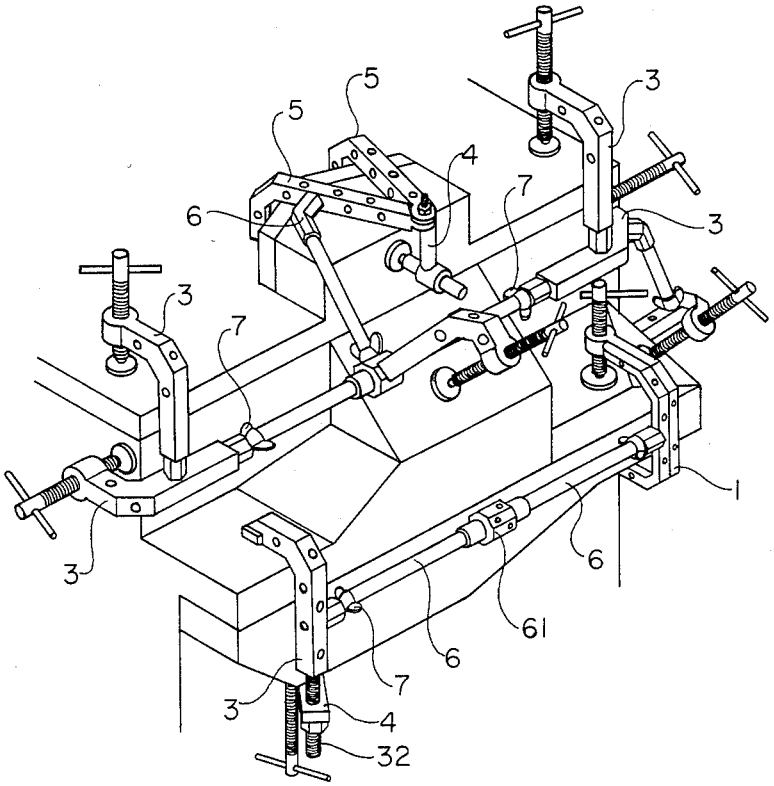

FIG. 15. An implementation example of this invention using various C type clamps and middle connectors to grip an object.

FIG. 1 and FIG. 2 show a C type clamp of this invention.

An one body system C type shaft shaft 1 has a square sectional view and around the 45 degrees turning places, several threaded holes 11 are drilled for connecting other half-sectioned system C type clamp or connecting middle connectors to extend and connect other sect of half-sectioned system C type clamp.

The threaded holes 11 on the various surfaces are made in interplay position, so that it does not affect the structure strength of the C type shaft body 1.

FIG. 3 shows a half-sectioned system C type clamp of this invention. It consists of an L-shaped shaft body 3, a threaded piston shaft 2 and a half-sectioned clamp jaw 35. On top of an L-shaped shaft body 3 where cut flat, a threaded hole 31 or a protruding threaded shaft is made. On the L-shaped shaft body 3, several threaded holes 11 facing different directions are drilled.

On a half-sectioned clamp jaw 35 where cut flat, a threaded hole is made to connect a central connector. As shown in the FIG. 3-2 and 3-3, the C type clamp of this invention consists of a C type shaft body 10 and a pressing threaded rod 20. There are:

With reference to FIG. 3-2 of the drawings, a preferred embodiment of the invention is clearly illustrated, wherein a C-clamp is adapted for interconnection to other C-clamps and tensioning devices. This preferred C-clamp comprises, in combination, a main body portion including a first leg having a boss provided with a threaded recess therein; and a threaded clamping rod is received in the threaded recess. The threaded clamping rod has a pair of ends, one of which ends is provided with a handle, and the other of which ends is provided with a clamping member. The main body portion further includes a second leg substantially perpendicular to the first leg and integral therewith, and this second leg is disposed substantially parallel to the threaded clamping rod. The main body portion further includes a third leg substantially perpendicular to the second leg and substantially parallel to the first leg and spaced therefrom. This third leg has a free end portion provided with an enlarged boss directed towards the threaded clamping rod, whereby an object may be clamped between the enlarged boss and the clamping member on the threaded clamping rod. The main body portion has a first plurality of respective blind bores formed therein in the plane thereof and opening externally of the main body portion of the C-clamp. The main body portion further has a second plurality of through bores formed therein substantially perpendicular to the plane of the main body portion and interspersed with the first plurality of blind bores, respectively. Each of the respective bores in the first and second plurality of bores is threaded to receive, selectively, a threaded adapter for interconnection to other C-clamps or tensioning devices.

Preferably, the main body portion includes a fourth leg integrally joining the first and second legs and disposed thereto at an angle of substantially 45 degrees, and the main body portion further includes a fifth leg integrally joining the second and third legs and disposed thereto at an angle of substantially 45 degrees. These fourth and fifth legs each has one of the blind bores formed therein.

Additionally, the main body portion further includes a sixth leg integrally joining the third leg with the enlarged boss and disposed thereto at an angle of substantially 45 degrees. This sixth leg has a threaded blind bore formed therein in the plane of the main body portion of the C-clamp and opening externally thereof.

Moreover, the enlarged boss has a blind threaded bore formed therein in the plane of the main body portion of the C-clamp; this blind threaded bore opens externally of the C-clamp and is formed on an axis which is substantially perpendicular to the threaded clamping rod. The enlarged boss further has a serrated face which cooperates with the clamping member on the threaded clamping rod for clamping an object therebetween.

As shown in the FIGS. 3-4 and 3-6, the middle connectors 60 are connected to non-piercing threaded holes 120 on a C type shaft body 10, and tighten by nuts 61 at their inserting ends. If the middle connectors are connected to a piercing holes 130, for tightening, the nuts are placed on the other side of a C type shaft 10 that middle connectors 60 are inserted, as the straight middle connector 60 in the FIG. 3-5.

As shown in the FIGS. 3-6 and 3-7, the structural design of the half-sectioned system C type clamp of this invention consists of an L-shaped shaft body 30 and a threaded pressing rod 20. The inner side of an L-shaped shaft body 30 that has a square shaft extends in the shape of a trapezoid as the re-inforced muscle 310 for having the better strength. There are piercing threaded holes 320 or piercing holes 330 on both sides and back surface of the square shaped shaft portion. There is a threaded hole 350 on the severance surface of an L-shaped shaft for connecting a middle extension connector 60.

The whole system C type clamp or the half-sectioned system C type clamp stated in the above may be connected together, as shown in the FIG. 1-2-3. The L-shaped shaft body 3 of a half-sectioned system C type clamp is directly connected or with a middle connector to the whole system C type clamp to form three clamping points in a triangular shape. The clamping point of a half-sectioned system C type clamp is vertical to a clamping line of the whole body C type clamp.

The design as shown in the FIG. 4, the clamping point of a C type clamp of this invention is not on the extended line of a threaded shaft. A threaded piston shaft 2 is piercing one end of a connecting column 4. On the other end of the connecting column 4, there is a multiple-sided (hexagonal or octagonal) column body, which can be inserted to a connecting end of a C type shaft body 1.

On a connecting end of a C type shaft, a multiple-sided column hole is drilled. On the side of this column hole, a side screw hole is made for a bolt 41 to be screwed in. After a connecting column is inserted into the column hole, it can be tighten by turning a bolt 41. By releasing a bolt 41, a connecting column 4 may be pulled out.

Matching the work object, the corner angle between a connecting column 4 and a C type shaft body 1 can be re-adjusted and re-bolted.

On the various surfaces of a C type shaft body 1, there are several threaded holes 11 of different angle directions that are intended to connect other half-sectioned C type clamp.

As shown in the FIG. 4-1-1, it is one design of this invention. A half-sectioned C type clamp is combined with the original C type clamp of which connecting column 4 angle is adjusted to fit the specific clamping surfaces. It grips three points on the three surfaces (such as triangle, irregular square, etc.). This is its specific feature.

One step ahead, this design may have a half-sectioned C type shaft. The L-type shaft 3, on its cut off surface, protrudes a proper length of a threaded extension shaft 32, as shown in the FIG. 5 and 5-1.

On a longer connecting column 4, make a lead hole or an adjustable threaded hole which is in parallel with a threaded piston 2.

The threaded piston 32 may be screwed into the adjustable threaded hole. It may be pre-locked by a nut 33 after adjusting to the needed width of an object. The firm grip can be made by tightening a threaded piston 2. This structure may be supplied to grip two points that are not on the same line but are on the paralleled surfaces as shown in the FIG. 5-2.

The connecting column 4 may turn around the threaded shaft 32 that is extending from the L-shaped shaft 3. It enables to grip any two points on two paralleled surfaces.

One step ahead, this invention may designed to be a clamp set by connecting two L-shaped shafts with one connecting column as shown in the FIG. 6, 6-1, and 6-2.

On the non-clamping ends of the L-shaped shafts 5, make two flanges 51 and one middle flange 52. They are facing each other. Put flanges 51 and 52 in layers, and drill a vertical, multiple-sided opening 53 for inserting a connecting multiple-sided Column 4. Extend a threaded shaft under the end of a connecting multiple-sided column 4. After it is inserted into a multiple-sided hole 53, a nut is screwed to it.

Thus two L-shaped shaft 5 and a connecting column 4 make up one clamp. The two L-shaped shaft 5 may expand widely to match the shape of the work object and after its gripping ends touch the object, place flanges 51 and flange 52 on layers together, insert and bolt the connecting column 4. Tighten the threaded piston 2 to grip work firmly as shown in the FIG. 6-3.

All C type shaft body 1 or various L-shaped shaft body 3 that stated above may have a rectangular shaft body. On thier shaft surfaces and cornered shaft surfaces, several threaded holes 11 are drilled for screwing other sets of an L-shaped shaft body 3 or a middle connector.

One step ahead, C type shaft body 1 and an L-type shaft body 3 may have a multiple-sided shape sectional view as shown in the FIG. 7, 7-1, and 7-2. But these threaded holes 11 are not piercing through the shaft body.

Another specific feature of this invention is that on all C type shaft body 1, an L-shaped shaft body 3 or the cut end of an L-shaped shaft body 3, there are threaded holes 31 or protruding threaded shafts. All of them can be fitted to connect middle connectors 6 as shown in the FIG. 8, 9 and 10.

A middle connector 6 is used to extend or change directions. A central connector includes a hexagonal column at its central part or its one end is threaded and the other end is drilled to be a threaded hole.

One step ahead, the middle connectors 6 may have other designs as shown in the FIG. 11, 11-1 and 11-2.

A middle partition body 61 has a multiple-sided column.

On each of the middle partition body 61, threaded holes are made to screw an L-shaped shaft body 3 or a middle connector 6.

At the combining point of a middle connector 6 and a C type or L-type shaft body, or another middle connector 6, a wing nut 7 may be attached as shown in the FIG. 12, 12-1. This wing nut may tighten a central connector 6 or other connecting end to perform the clamping function.

A middle connecting shaft 60 is shown in the FIG. 12-1. It is a shaft body with a proper length. Both ends are smaller diameter threaded shaft 510.

These smaller diameter threaded shaft 510 can be screwed into the threaded holes 120, 320 of the above stated C type shaft body 10 or an L-type shaft body 30. They can also pierce through a larger openings 130, 330 and fixed by bolts 61. One end of a threaded shaft 510 can be inserted into a C type shaft body 10 or an L-type shaft body 30 and fixed with a bolt.

Thus a tight pressing clamping can be made by turning the bolts.

The surface of the central portion of a middle connector 6 can have knurls for easy grip.

Its central portion may be cut to be flat surfaces 620. When its both ends are screwed to a C type clamp or other middle connectors, it may turn tight by applying a wrench on the cut flat surface.

A central direction diversifying connector of this invention is shown in the FIG. 12-3. It may have a multiple-sided shape body. There are piercing threaded or non-piercing threaded openings 720 on each surfaces. This threaded openings 720 can be connected with the smaller diameter threaded shafts 510 on both ends of the middle connector 60.

By connecting in this way, the C type clamp may be expanded in the multiple direction and may make multiple-angled extension.

The extension function of middle connectors 6 is shown in the FIGS. 8-3, 8-3-1, 8-3-2. A wing nut 7 can tighten the connection. Thus an L-type shaft body 3 can be assembled and connected to clamp an extra large work object. This is its specific feature.

The clamp body design is shown in the FIG. 13. A threaded piston shaft 2 is screwed through a connecting column 4. Its lower part is a square solid body 45. On each surface of the square solid body, piercing openings in the shape of an oblong, square, round or multiple-sided is made for connecting an extension shaft 8 which has the corresponding sectional shape.

On the extension shaft 8, several openings or threaded holes are drilled at regular intervals. After it is connected to the square solid body 45 of a connecting column 4, it can be fixed with a bolt or pin as shown in the FIG. 13-1, 13-2.

This design, one step ahead, the lower end of a connecting column 4 may have a multiple-sided column body. On each surface of the multiple-sided column body, oblong openings or round openings may be made allowing an extension shaft 8 to be inserted to connect a connecting column 4 from various angle corresponding to a work object situation.

An L-shaped shaft body 3 of a half-sectioned system C type clamp is shown in the FIG. 14, 14-1. On the cut off place, there is a square solid body 45 or a multiple-sided column body 46.

As stated in the above, each surface of the multiple-sided column body 46 can be connected with an extension shaft 8 through a threaded hole. It an be extended in various angle direction to hold a longer clamping distance.

The extension shaft 8 may be made as a regular or irregular steps system shaft body or may have an indented or protruded surface for the convenience of connection.

Various system clamp bodies of this invention clamp an assembled work object or a work object that awaits processing as shown in the FIG. 15. Operations can be completed at the same time without clamping one by one.

I claim:

1. A C-clamp adapted for interconnection to other like C-clamps and to other tensioning devices by means of at least one threaded adapter and comprising, in combination a main body portion including a first leg having a boss provided with a threaded recess therein, a threaded clamping rod received in the threaded recess, the threaded clamping rod having a pair of ends, one of which ends is provided with a handle, and the other of which ends is provided with a clamping member, the main body portion further including a second leg substantially perpendicular to the first leg and integral therewith, the second leg being disposed substantially parallel to the threaded clamping rod, the main body portion further including a third leg substantially perpendicular to the second leg and substantially parallel to the first leg and spaced therefrom, the third leg having a free end portion provided with an enlarged boss directed towards the threaded clamping rod, whereby an object may be clamped between the enlarged boss and the clamping member on the threaded clamping rod, the main body portion further includes a fourth leg integrally joining the first and second legs and disposed thereto at an angle of substantially 45 degrees, and wherein the main body portion further includes a fifth leg integrally joining the second and third legs and disposed thereto at an angle of substantially 45 degrees, wherein the fourth and fifth legs each has one of said blind bores formed therein, the main body portion having a first plurality of respective blind bores formed therein in the plane thereof and opening externally of the main body portion of the C-clamp, the main body portion further having a second plurality of through bores formed therein substantially perpendicular to the plane of the main body portion and interspersed with the first plurality of blind bores, respectively, and each of the respective bores in the first and second plurality of bores being threaded to receive, selectively, at least one threaded adapter for interconnection to the other C-clamps or tensioning devices.

2. The combination of claim 1, wherein the main body portion further includes a sixth leg integrally joining the third leg with the enlarged boss and disposed thereto at an angle of substantially 45 degrees.

3. The combination of claim 2, wherein said sixth leg has a threaded blind bore formed therein in the plane of the main body portion of the C-clamp and opening externally thereof.

4. The combination of claim 1, wherein the enlarged boss has a blind threaded bore formed therein in the plane of the main body portion of the C-clamp, the blind threaded bore opening externally of the C-clamp and being formed on an axis which is substantially perpendicular to the threaded clamping rod.

5. The combination of claim 1, wherein the enlarged boss has a serrated face for cooperation with the clamping member on the threaded clamping rod for clamping an object therebetween.

* * * * *